US008905660B2

(12) United States Patent
Kiemele et al.

(10) Patent No.: US 8,905,660 B2
(45) Date of Patent: Dec. 9, 2014

(54) PRINTER AND METHOD FOR CONTROLLING REST STATE TRANSPORT OF THE PRINTING MEDIUM

(75) Inventors: Harry Kiemele, Villingen-Schwenningen (DE); Andreas Lindinger, Floezlingen (DE)

(73) Assignee: Continental Automotive GmbH, Hannover (DE)

( * ) Notice: Subject to any disclaimer, the term of this patent is extended or adjusted under 35 U.S.C. 154(b) by 1597 days.

(21) Appl. No.: 10/554,276

(22) PCT Filed: Jun. 3, 2005

(86) PCT No.: PCT/EP2005/052552

§ 371 (c)(1),
(2), (4) Date: Oct. 25, 2005

(87) PCT Pub. No.: WO2006/018331

PCT Pub. Date: Feb. 23, 2006

(65) Prior Publication Data

US 2006/0257192 A1 Nov. 16, 2006

(30) Foreign Application Priority Data

Aug. 17, 2004 (DE) ..... 10 2004 039 943

(51) Int. Cl.

| | |
|---|---|
| ***B41J 11/42*** | (2006.01) |
| ***B41J 11/00*** | (2006.01) |
| ***B41J 2/325*** | (2006.01) |
| ***G07C 7/00*** | (2006.01) |

(52) U.S. Cl.

CPC ..... *G07C 7/00* (2013.01)

USPC ..... 400/583; 400/611; 400/120.01; 347/171

(58) Field of Classification Search

USPC ..... 400/583, 621, 88, 611, 120.01; 101/288; 347/171

See application file for complete search history.

(56) References Cited

U.S. PATENT DOCUMENTS

| | | | | |
|---|---|---|---|---|
| 5,653,435 | A | 8/1997 | Yoneda | |
| 5,733,052 | A | 3/1998 | Suzuki | |
| 6,196,741 | B1 | 3/2001 | Koshi et al. | |
| 6,210,515 | B1 * | 4/2001 | Boreali et al. | 156/250 |
| 6,392,677 | B1 | 5/2002 | Lais | |
| 6,437,815 | B1 * | 8/2002 | Burkart | 347/222 |
| 6,585,437 | B1 * | 7/2003 | Wiklof et al. | 400/621 |
| 2005/0057634 | A1 | 3/2005 | Huegle | |
| 2006/0222430 | A1 * | 10/2006 | Duckett et al. | 400/583 |

FOREIGN PATENT DOCUMENTS

| | | | |
|---|---|---|---|
| EP | 0 263 319 | A2 | 4/1988 |
| JP | 11-320989 | A | 11/1999 |

OTHER PUBLICATIONS

Partial English language translation of Sakai et al. (JP 11-320989 A).*

Patent Abstracts of Japan—JP 11-320989 A; Nov. 24, 1999; Matsushita Electric Ind Co Ltd.

* cited by examiner

*Primary Examiner* — Leslie J Evanisko

(74) *Attorney, Agent, or Firm* — Cozen O'Connor

(57) ABSTRACT

A printer and a method of controlling a printer in order to print out a report relating to data recorded by a tachograph are disclosed, the printer having a supply of printing medium and being equipped with a medium transport device. In the disclosed printer, rest state transport of the printing medium is carried out at periodically repeating intervals.

17 Claims, 2 Drawing Sheets

PRINTER AND METHOD FOR CONTROLLING REST STATE TRANSPORT OF THE PRINTING MEDIUM

BACKGROUND OF THE INVENTION

The invention relates to a printer for printing out a report relating to data recorded by a tachograph in a commercial vehicle, comprising a supply of printing medium, comprising a medium transport device by means of which printing medium can be conveyed in an output transport direction, comprising a control unit which controls at least the medium transport device. In addition, a method for controlling a printer of the aforementioned type is a subject of the invention.

German patent application DE 102 15 122 has already disclosed such a printer. These apparatuses are often of small format, and the printing medium, stored in a printing supply as a coiled strip, is provided with a print-out by means of a print head in the thermal printing process. The printing medium regularly rests on a pressure roller, which leads the printing medium to the print head, even during stoppages. If a printer, in particular of the type described here, is not used for a relatively long time, the printing medium can enter into an adhesive connection, in particular bond adhesively, with components on which it rests, under the action of the atmospheric humidity of the surroundings and the temperature fluctuations. This process is particularly critical in the case of a printer of a tachograph in a commercial vehicle, where all the unfavorable factors which accelerate the undesired process are present. The printing medium is regularly designed as suitable for thermal printing at this location, from time to time the atmospheric humidity is relatively high and the temperature fluctuations are extraordinarily wide. The undesired adhesive bonding of the printing medium with components on which said printing medium rests, for example with a pressure roller, leads to a paper jam if the printer is started up in order to output a print-out after a relatively long stoppage.

SUMMARY OF THE INVENTION

On the basis of the outlined problem, the object of the invention is to avoid printing medium jams in a printer after a relatively long stoppage time.

In order to achieve the object, the invention proposes that the control unit of a printer of the type mentioned at the beginning be designed such that it activates the medium transport device in such a way that the medium transport device carries out a rest state transport at periodic intervals, within which, even without the presence of a print job, the medium transport device transports the printing medium in and/or counter to an output transport direction. In addition, for the purpose of achievement, a method of the type mentioned at the beginning is proposed in which, even without a print job, a medium transport device transports the printing medium in and/or counter to an output transport direction at periodic intervals during rest state transport.

The rest state transport according to the invention at periodic intervals effectively prevents the formation of an adhesive connection or the adhesive bonding of the printing medium with components which are in contact with the printing medium. This cause of a paper jam is thus effectively eliminated.

In one embodiment, the rest state transport is carried out at periodically repeating intervals of between 10 hours and 40 hours.

An advantageous development of the invention provides for the conveying travel of the rest state transport of the printing medium in one direction to be between 0.5 mm and 30 mm. An advance of the printing medium by about two lines of print or 5 mm has proven to be particularly expedient, with which the adhesive bonding could be effectively prevented and, at the same time, the additional power requirement was restricted to an acceptable level.

The control is advantageously designed in such a way that it activates the medium transport device during the rest state transport in such a way that the printing medium is initially conveyed from an initial position counter to the output transport direction and is then transported back into the initial position in the output transport direction. This procedure has the critical advantage that, first of all, the printing medium preferably entering into a connection with the pressure roller is pulled continuously by the pressure roller located in the region of the print head, so that even high forces resulting from adhesive bonding can be overcome without difficulty by the printing medium loaded in tension. At the same time, the system comes into the initial position present before the rest state transport, so that this procedure can be repeated virtually without limit. The construction of a printer according to the invention develops particular advantages if the printing medium of the supply is rolled up as a coiled strip. In this case, the loosening of slight adhesions in the region of the outer circumference of the coiled strip also occurs regularly. Since the problem on which the invention is based often occurs in apparatuses constructed as thermal printers, the design of the control according to the invention is particularly expedient here. Particularly high adhesive forces have to be overcome regularly where a pressure roller presses the printing medium against a print head, so that a construction according to the invention is particularly practical in conjunction with an arrangement of this type.

In order to avoid a printing medium jam under all circumstances when starting a printing job, the control of the printer can advantageously be designed in such a way that, at the start of an activation of the printer caused by means of a print job, activation is initially carried out in such a way that the rest state transport takes place in the manner previously described before the print job is processed. In this case, it is expedient in particular to ensure first of all that there is transport within a small conveying travel counter to the output transport direction, so that the printing medium, which is regularly unstable with respect to pressure, overcomes the resistance of adhesive bonding by means of tension.

BRIEF DESCRIPTION OF THE SEVERAL VIEWS OF THE DRAWINGS

In the following text, the invention is illustrated in detail by using a specific exemplary embodiment with reference to the two drawings, in which.

DETAILED DESCRIPTION OF THE INVENTION

Figure 1:
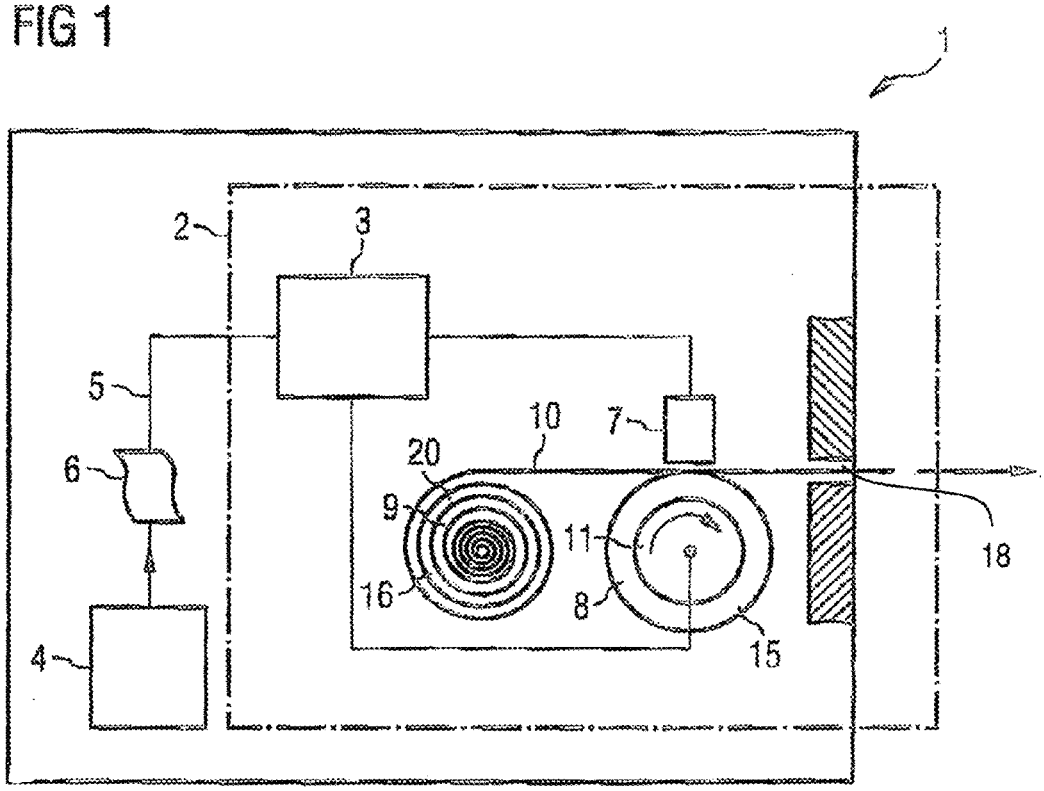
FIG. 1 shows a schematic illustration of a printer according to the invention in a tachograph.

FIG. 1 shows a tachograph 1 which has an integrated printer 2. A control unit 3 of the printer 2 is connected 5 to a higher-order controller 4 of the tachograph 1 so as to transmit signals. By means of the connection 5, the controller 4 transmits print jobs 6 to the control unit 3.

Important components of the printer 2 are the control unit 3, a print head 7, a medium transport device 15 comprising a pressure roller 8 and a supply 9 of printing medium 10 formed as a coiled strip 16. By means of a drive 11, the control unit 3 controls a rotary movement of the pressure roller 8 in order to convey the printing medium 10 in an output transport direction 12, so that the printing medium 10 emerges from the printer 2 of the tachograph 1 from an outlet opening 18, and a user can obtain a print-out. In order to print out a report relating to data recorded by the tachograph 1, the control unit 3 receives the print job 6 from the controller 4 and activates the print head 7 and the drive 11 of the pressure roller 8 appropriately. The printing medium 10 here is thermal printing paper 20 and the print head 7 operates in the thermal printing process.

Figure 2:
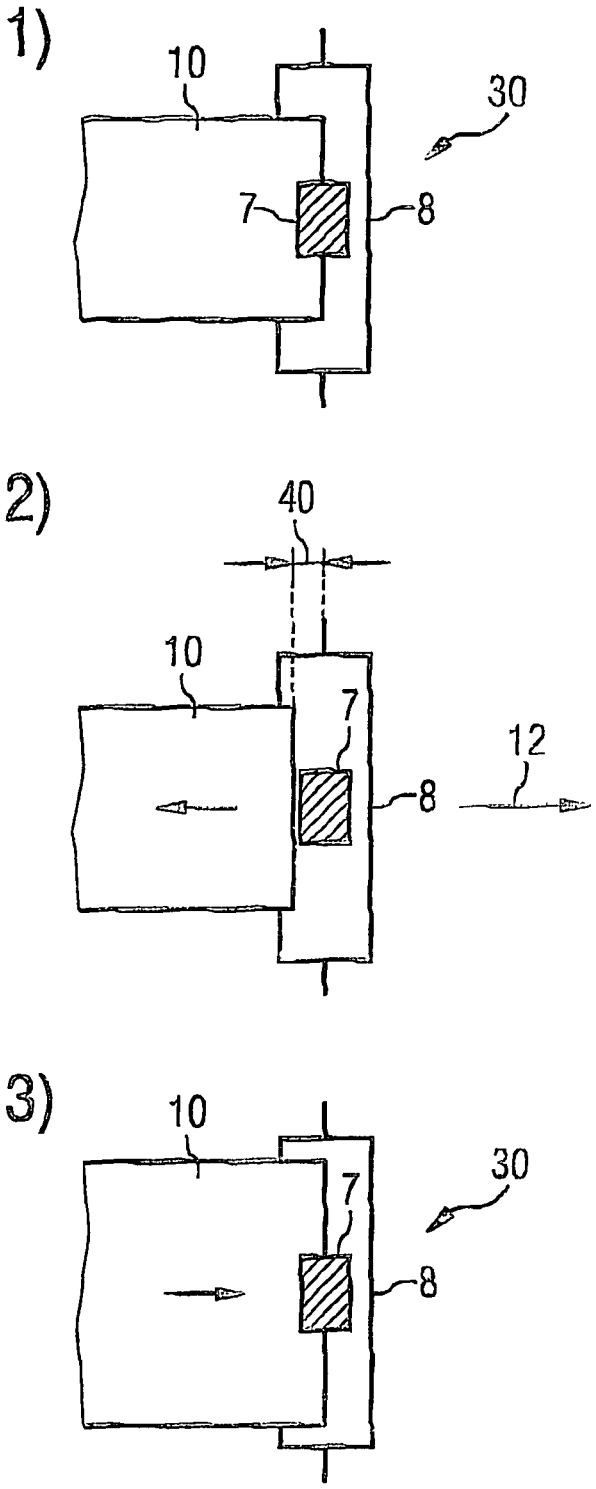
FIG. 2 shows the sequence of the rest state transport in a printer according to the invention according to the method of the invention.

In order that, during relatively long stoppage times, the printing medium 10 does not adhere firmly to the pressure roller 8 under the pressure of the latter, in particular under the action of atmospheric humidity and temperature fluctuations, the invention provides that, even during a relatively long time of the rest state, rest state transport according to the illustration of FIG. 2 is provided. Starting from the initial position 30 designated by 1), in which the printing medium 10 rests on the pressure roller 8 under the pressure of the latter, the printing medium 10 is moved along a short conveying travel 40 opposite to the output transport direction 12, as illustrated in 2). The printing medium 10 is then conveyed into the initial position 30 again in the output transport direction 12, as illustrated in 3).

The invention claimed is:

1. A printer for printing out a report relating to data recorded by a tachograph in a commercial vehicle, the printer comprising:

a supply of printing medium, a medium transport device arranged such that the printing medium can be conveyed in an output transport direction, and a control unit arranged to control at least the medium transport device, wherein the control unit activates the medium transport device in such a way that the medium transport device carries out a rest state transport at periodic intervals, and carries out the rest state transport at the start of an activation of the printer caused by receipt of a print job before processing the print job, and wherein, during the rest state transport, the medium transport device transports the printing medium in and opposite to the output transport direction.

2. The printer according to claim 1, wherein a conveying travel of the rest state transport of the printing medium in one direction is between 0.5 mm and 30 mm.

3. The printer according to claim 1, wherein the control unit is arranged to activate the medium transport device during the rest state transport in such a way that the printing medium is initially conveyed from an initial position counter to the output transport direction and is then transported back into the initial position in the output transport direction.

4. The printer according to claim 1, wherein the printing medium of the supply is rolled up as a coiled strip.

5. The printer according to claim 1, wherein the printer is a thermal printer and the printing medium is thermal printing paper.

6. The printer according to claim 1, wherein the printer comprises a print head, the printing medium is arranged to be fed to the print head by means of a pressure roller, and the printing medium is arranged to rest upon the pressure roller.

7. The printer according to claim 1, wherein the control unit is arranged such that at the start of an activation of the printer the printer causes by means of a print job, activation to be initially carried out in such a way that the rest state transport takes place before the print job is processed.

8. A method for controlling a printer in order to print out a report relating to the data recorded by a tachograph in a commercial vehicle, the method comprising:

transporting a printing medium by a medium transport device in and opposite to an output transport direction at periodic intervals during a rest state transport, and transporting the printing medium by the medium transport device in and opposite to the output transport direction at the start of an activation of the printer caused by receipt of a print job before processing the print job.

9. The method according to claim 8, wherein a conveying travel of the rest state transport of the printing medium in one direction is between 0.5 mm and 30 mm.

10. The method according to claim 9, wherein the printer is a thermal printer and the printing medium is thermal printing paper.

11. The method according to claim 8, wherein, during the rest state transport, the printing medium is initially conveyed from an initial position counter to the output transport direction and is then transported back into the initial position in the output transport direction.

12. The method according to claim 8, wherein the printing medium is rolled up as a coiled strip.

13. The method according to claim 8, wherein the printing of the printing medium is carried out by means of a print head, the printing medium is fed to the print head by means of a pressure roller, and the printing medium rests on the pressure roller.

14. The method according to claim 8, wherein, at the start of an activation of the printer caused by means of a print job, the rest state transport takes place before the print job is processed.

15. The method according to claim 8, wherein the rest state transport is carried out at periodically repeating intervals of between 10 hours and 40 hours.

16. A combination including a printer integrated in a tachograph for printing out a report relating to data recorded by the tachograph in a commercial vehicle, the tachograph comprising a higher order controller;

the printer comprising:

a supply of printing medium, a medium transport device arranged such that the printing medium can be conveyed in an output transport direction, and a control unit arranged to control at least the medium transport device, wherein the control unit is arranged to activate the medium transport device in such a way that, at the start of an activation of the printer caused by receipt of a print job by the control unit from the higher order controller and before processing the print job, the medium transport device carries out a rest state transport, within which rest state transport, the medium transport device transports the printing medium in and opposite to the output transport direction.

17. The combination according to claim 16, wherein the control unit is arranged to activate the medium transport device during the rest state transport in such a way that the printing medium is initially conveyed from an initial position counter to the output transport direction and is then transported back into the initial position in the output transport direction.

* * * * *